US005211188A

United States Patent [19]

Kraus

[11] Patent Number: 5,211,188

[45] Date of Patent: May 18, 1993

[54] DISHWATER ADDITIVE DISPENSING APPARATUS

[75] Inventor: Frederick L. Kraus, Louisville, Ky.

[73] Assignee: General Electric Company, Louisville, Ky.

[21] Appl. No.: 816,657

[22] Filed: Jan. 3, 1992

[51] Int. Cl.[5] ..... A47L 15/44

[52] U.S. Cl. ..... 134/93; 220/336; 222/557

[58] Field of Search ..... 134/56 D, 57 D, 57 DL, 134/58 D, 58 DL, 93; 222/542, 557, 651, 652; 220/336, 344; 215/236, 344

[56] References Cited

U.S. PATENT DOCUMENTS 3,406,695 10/1968 Perl ..... 134/93 X
4,149,657 4/1979 Nelson et al. ..... 134/93 X
4,442,947 4/1984 Banich, Sr. ..... 215/344

FOREIGN PATENT DOCUMENTS 1435710 3/1966 France ..... 134/93
788148 12/1957 United Kingdom ..... 215/344

*Primary Examiner*—Philip R. Coe

[57] ABSTRACT

An additive dispenser for a dishwashing machine includes a container formed in the inner wall of the machine door and a cover movable between a position closing the container and a position exposing the container. The cover is formed as an unitary member with a central cuplike base and an outwardly extending, flexible rim to engage a sealing ring around the container. The cover is formed from a thermoplastic, preferably polypropylene, with an integral lubricant, preferably silicone.

7 Claims, 1 Drawing Sheet

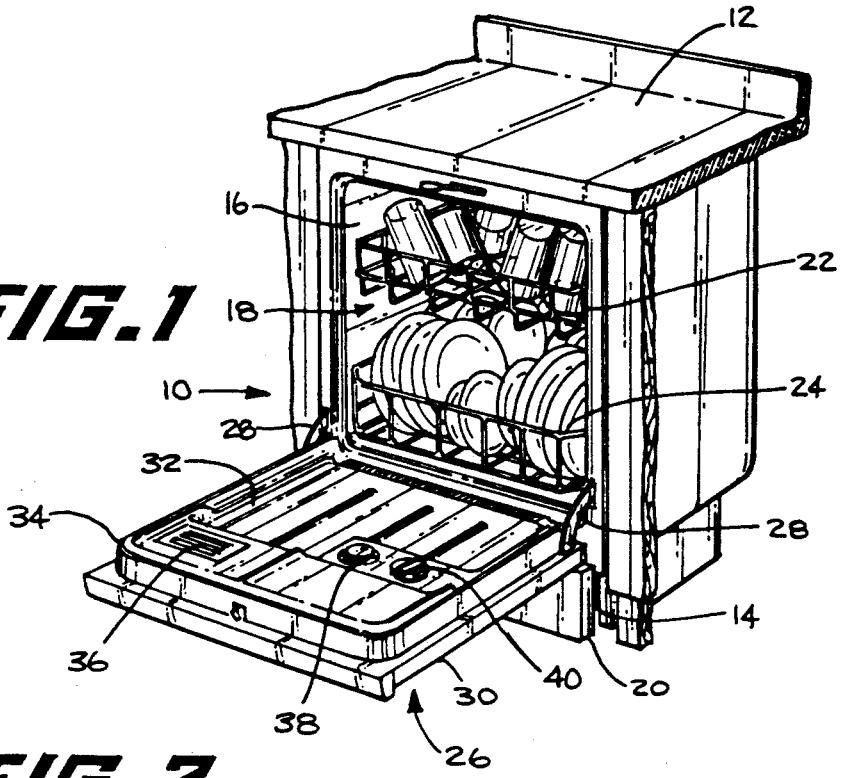
FIG. 1
FIG. 2
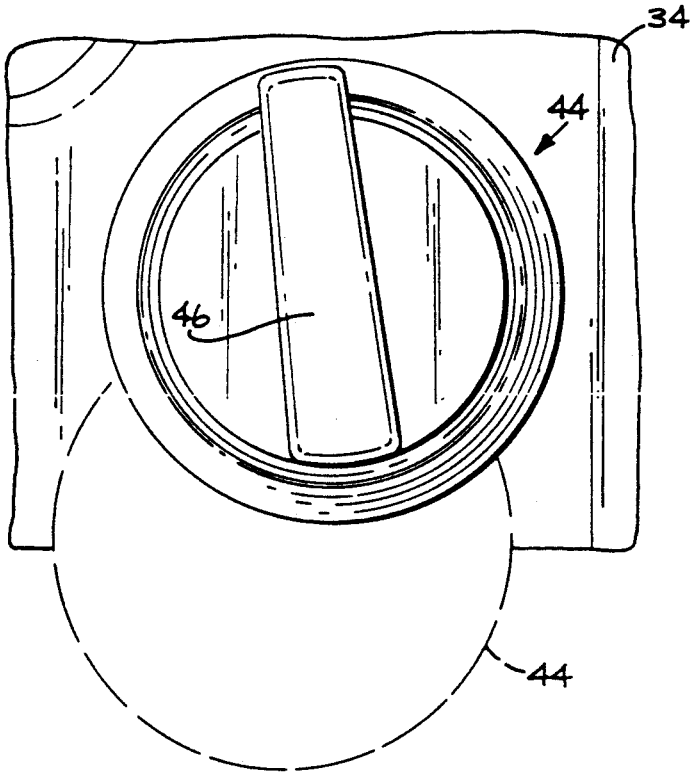
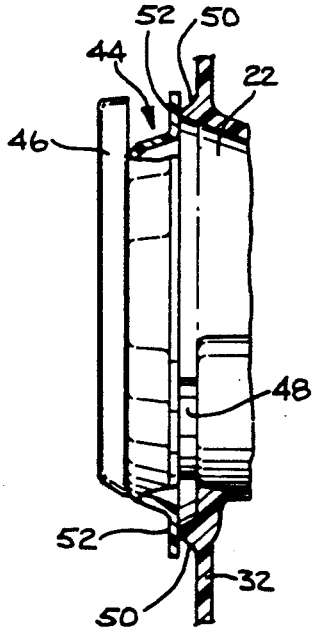
FIG. 3

DISHWATER ADDITIVE DISPENSING APPARATUS

BACKGROUND OF THE INVENTION

The present invention relates to automatic dishwashers and, more particularly, an improved apparatus to dispense an additive, such as a detergent, into the washer at the appropriate time.

Conventional domestic dishwashers operate through a preselected series of timed wash and rinse cycles, during which additives are added to the wash or rinse water at appropriate times. For example, detergent may be dispensed at different times during the wash cycle or operation and rinse agent dispensed during the rinse operation. Apparatus to automatically dispense additives, such as detergent and rinse agent for example, are well known. U.S. Pat. No. 4,159,657—Nelson et al, assigned to General Electric Company illustrates and describes one such dispensing mechanism and is incorporated herein by reference. As set forth therein, the dispenser is installed in the door of the dishwasher. It includes a main part in the form of an additive storage reservoir or container formed integrally with the inner wall of the door. The reservoir is supplied with additive when the door is in its open (horizontal) position. A closure device, comprising a cover and handle, is then rotated over the reservoir and the cover is drawn tight against the container by manual operation of the handle. The apparatus also includes a spring driven, timer controlled mechanism to open the cover for dispensing the additive at a preselected time during operation of the machine. In order to tightly seal the container a sealing ring extends around the periphery of the container and the cover includes a gasket which is mounted on the underside of the cover and firmly engages the sealing ring when the cover closes. This apparatus works well and provides a good vapor seal to protect the additive from the water being sprayed about the inside the washer. However the cover and gasket assembly includes a number of parts and requires a number of assembly steps In addition, the gasket requires a clorination processing step to reduce its coefficient of friction so that it will not "stick" to the ring as the cover opens and closes. This all adds to the cost and manufacturing time of the apparatus.

It is therefore an object of this invention to provide an improved dispensing apparatus which is constructed from a minimum number of parts while providing consistent performance.

It is another object of this invention to provide such an apparatus including an unitary cover that does not require a sealing gasket.

SUMMARY OF THE INVENTION

The present invention relates to improved apparatus for dispensing additives into automatic dishwashing machines and, more particularly, such apparatus for use with front loading dishwashers. In a preferred form, the dispensing apparatus includes a container formed in the inner wall of the door of the dishwasher. A sealing ring, also formed integrally with the door extends outwardly of the door around the periphery of the container. An unitary cover is mounted to move between a first position removed from the container and a second position sealing the container. The cover includes a flexible rim which is complementary in shape to the sealing ring and firmly engages the ring when the cover is in its second position. The cover preferably is formed of molded polypropylene with about two percent by weight of silicone to reduce its coefficient of friction

BRIEF DESCRIPTION OF THE DRAWINGS

Other features and advantages will be apparent from the following description taken in conjunction with the accompanying drawings wherein:

FIG. 1 is a simplified and somewhat schematic front perspective view of an under-counter dishwashing machine, with the access door in its open position.

FIG. 2 is a plan view of a portion of the inner wall of the door of FIG. 1, showing the dispenser cover in its closed position (solid line) and in its open position (dashed line).

FIG. 3 is a fragmentary side elevational view of a portion of the inner door wall illustrating the container with the cover in its closed position.

DETAILED DESCRIPTION OF THE PREFERRED EMBODIMENTS

In the following detailed description the illustrative embodiment of the invention is in the form of a detergent dispenser; however, it will be understood that the invention is applicable to dispensers of other additives such as for example, rinse agents.

FIG. 1 illustrates, in somewhat schematic form, a domestic dishwasher 10 of the "built-in" or "under counter" type. That is dishwasher fits under the typical kitchen counter 12. The dishwasher includes an outer cabinet 14 and a tub 16 which forms a washing chamber 18. The tub 16 may be formed as a one piece structure of molded thermoplastic material, such as polypropylene, and is supported in the upper portion of the outer cabinet 14. The lower portion of the cabinet 14 includes a machinery compartment which is accessed by a removable lower door 20. Upper and lower racks 22 and 24 respectively support dishes, utensils and other items to be washed and are moveably mounted in the tub 16 so that they can be pulled out for loading and unloading. Typically a motor and pump located in the machinery compartment withdraw water from the tub and directs it through various spray devices to wash and rinse the items in the racks.

An upper door 26 is mounted by at mechanism including hinges 28 to pivot between a substantially horizontal position shown in FIG. 1, in which it provides access to the wash chamber 18, and a substantially vertical position, in which it is closed against the front edge of the tub 16 to close the wash chamber 18. The upper door 26 includes a peripheral frame 30 supporting an inner door wall or panel 32 and an outer door wall, not shown. Conveniently the inner door wall is molded from a thermoplastic material, such as a polypropylene. A gasket 34 is mounted adjacent the outer edge of the inner door wall 32 and seals against the front edge of the tub 16 to prevent water leakage around the door when the machine operates. Various controls are normally mounted between the inner and outer walls of the upper door, the inner wall is provided with a vent 36 to permit heat and water vapor to escape through the door, and both a rinse aid dispenser 38 and a detergent dispenser 40 are mounted on the inner wall 32.

As illustrated in FIGS. 2 and 3, the detergent dispenser includes a cup like recess molded integrally with the inner door wall 32 to form a container or receptacle 42 for detergent and a cover 44 which selectively closes the container 42. As is described in detail in the aforementioned U.S. Pat. No. 4,149,657 the cover such as that indicated at 44 is provided with a handle 46 for manual operation and is mounted on an operating shaft 48. The shaft is connected to a spring loaded, timer controlled mechanism for opening the cover at a preselected time during operation of the dishwasher. A sealing ring 50 is integrally molded as part of wall 32 and projects outwardly of the wall around the periphery of the container 42.

When the door 26 is open, that is in the horizontal position shown in FIG. 1, and the cover 44 is open, that is in the position shown in dashed lines in FIG. 2, the container is exposed. The user then pours the desired amount of detergent into the container 42 and closes the cover 44 by rotating the handle 46 clockwise, as seen in FIG. 2. As the handle is rotated the cover moves angularly into register with the container 42 and linearly toward the wall 32 to bring the peripheral rim 52 of the cover 44 into sealing engagement with the sealing ring 50. When the door 26 is closed the dispenser assumes the orientation shown in FIG. 3, and the spring loaded operating mechanism will open the cover at a predetermined time during operation of the dishwasher. At that time the cover moves outwardly of the wall 32 and angularly of the container 42 to its open position. This permits the detergent to fall from the container into the chamber 18 and exposes the container 42 to the water being sprayed in the chamber 18. This assures that the container is thoroughly cleaned of detergent.

The compound or complex motion of the cover 44 in opening and closing results in the rim 52 and ring 50 having a wiping engagement. To assure proper operation and long life it is necessary to reduce the friction of the engagement. In the prior art, as illustrated by the U.S. Pat. No. 4,149,657, for example, the cover is provided with a separate gasket which assures a sealing engagement while limiting the coefficient of friction involved. However, such structures involve additional parts and manufacturing steps. This increases the cost of manufacture and provides more parts that potentially may wear out or fail.

The present invention reduces (or controls) the friction of engagement between the cover 44 and the sealing ring 50 with a minimum number of parts and without the necessity of a separate gasket. The cover 44 is formed as an unitary molded body having a cup shaped body 54 and rim 52. The rim 52 projects outwardly of the body 54 and is normally generally parallel to the surface of the adjacent portion of the inner door wall 32. The rim is relatively thin and slightly flexible so that, when the cover moves toward the wall and the rim 52 engages the sealing ring 50, the rim will flex or give slightly to assure a tight engagement despite manufacturing tolerances. The cover preferably is molded from a thermoplastic material with an integral lubricant. For example it may be formed from a poly-alpha-olefin with a silicone additive. In the illustrative embodiment the cover is formed from polypropylene with about 2% by weight of silicone. This assures that the coefficient of friction between the rim 52 and ring 50 is sufficiently low not to bind as they move into and out of engagement.

What is claimed as new is:

1. Apparatus for dispensing additive into a wash chamber of an automatic washing machine, comprising:

a door pivotally mounted for movement between a first position providing access to said chamber and a second position for closing said chamber, said door including an inner door wall exposed to said chamber when said door is in its second position;

a container formed in said inner door wall and disposed to receive an additive when said door is in its first position and to dispense additive into said chamber when said door is in its second position;

a continuous sealing ring extending outwardly of said inner door wall about the periphery of said container; and a cover mounted for movement between a first position exposing said container for adding and dispensing additive and a second position sealing said container, said container cover including a generally planar flexible rim complementary in shape to said sealing ring; said flexible rim extending outwardly of said cover and generally perpendicular to said sealing ring and firmly engaging said sealing ring when said cover is in its second position.

2. An apparatus as set forth in claim 1, wherein: said cover includes a cup shaped body projecting outwardly of said inner door wall and said cover rim is unitary with and projects outwardly of said body generally parallel to said inner door wall.

3. An apparatus as set forth in claim 2, wherein; said cover rim is flexed slightly outward of said inner door wall when said cover is in its second position.

4. An apparatus as set forth in claim 1 wherein: said cover is formed of a molded poly-alpha-olefin with silicone lubricant.

5. An apparatus as set forth in claim 1 wherein: said cover is molded propylene containing lubricant to ease the friction of the engagement between said rim and said sealing ring.

6. An apparatus as set forth in claim 1, wherein: said cover is formed of polypropylene containing a minor percent by weight of silicone.

7. An apparatus as set forth in claim 6, wherein: silicone is about two percent by weight of the material of said cover.

* * * * *